US005881949A

United States Patent [19]

Focke

[11] Patent Number: 5,881,949

[45] Date of Patent: Mar. 16, 1999

[54] CARDBOARD PACKING CONTAINER

[75] Inventor: Heinz Focke, Verden, Germany

[73] Assignee: Focke & Co. (GmbH & Co.), Verden, Germany

[21] Appl. No.: 785,135

[22] Filed: Jan. 13, 1997

[30] Foreign Application Priority Data

Jan. 15, 1996 [DE] Germany ..... 196 01 192.2

[51] Int. Cl.[6] ..... B65D 5/24; B65D 5/68

[52] U.S. Cl. ..... 229/125.31; 229/143; 229/151; 229/186

[58] Field of Search ..... 229/125.31, 143, 229/151, 186

[56] References Cited

U.S. PATENT DOCUMENTS

| | | | |
|---|---|---|---|
| 430,045 | 6/1890 | Soper | 229/143 |
| 1,003,150 | 9/1911 | Potter | 229/151 |
| 1,047,024 | 12/1912 | Fenlason | 229/125.31 |
| 1,616,014 | 2/1927 | Walter . | |
| 1,830,495 | 11/1931 | Walter . | |
| 2,206,304 | 7/1940 | Ringler | 229/186 |
| 2,443,531 | 6/1948 | Berch | 229/151 |
| 3,126,142 | 3/1964 | Goetz | 229/186 |
| 3,315,868 | 4/1967 | Hempfling . | |
| 4,136,816 | 1/1979 | Gardner . | |

FOREIGN PATENT DOCUMENTS

| | | |
|---|---|---|
| 896412 | 2/1945 | France . |
| 1149293 | 5/1963 | Germany . |
| 7005841 | 2/1970 | Germany . |
| 8603657 | 5/1986 | Germany . |
| 9201167 | 5/1992 | Germany . |
| 26792 | 11/1931 | Netherlands . |
| 1035573 | 7/1966 | United Kingdom . |
| 9527658 | 10/1995 | WIPO . |

*Primary Examiner*—Gary E. Elkins
*Attorney, Agent, or Firm*—Sughrue, Mion, Zinn, Macpeak & Seas, PLLC

[57] ABSTRACT

Packing container made of foldable packaging material, especially cardboard.

The packing container consists of two parts, namely a container-like base part (10), open at the top, and a covering part (11) which can be placed on same. The base part (10) forms folds, namely folding units (30, 31) in the region of end walls (17, 18). Cover flaps (20, 21) of the upper covering part (11) enter the folding units in such a way that the folds of the end wall (17, 18) are fixed in the folded position by the insertion tabs (20, 21). Pulling out the insertion tabs (20, 21) frees the folds and thus the base part (10) can be shaped into a flat position.

11 Claims, 9 Drawing Sheets

Fig. 1
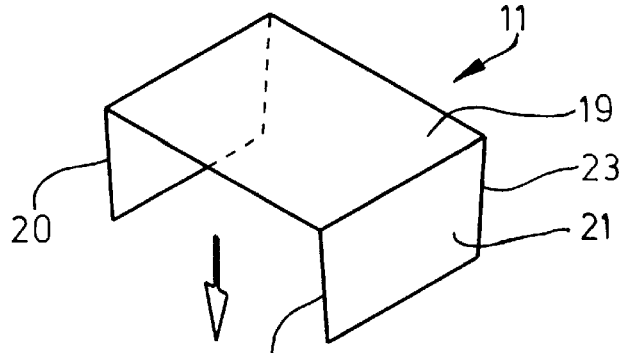
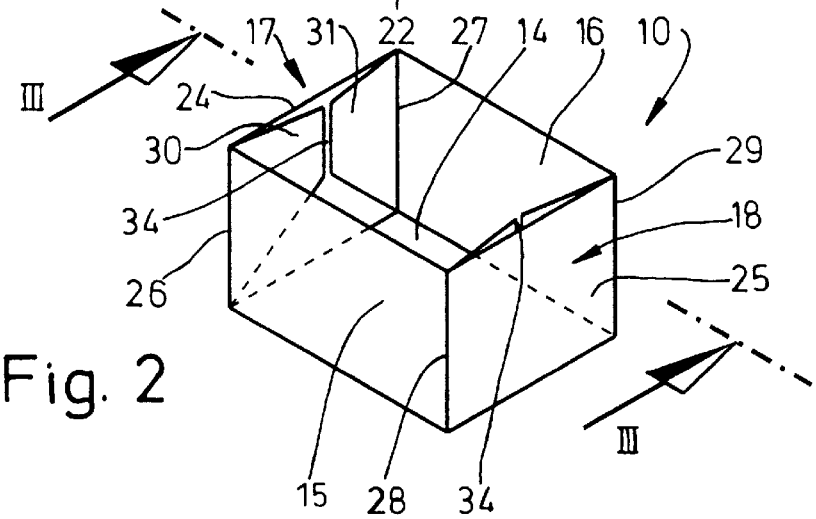
Fig. 2
Fig. 3
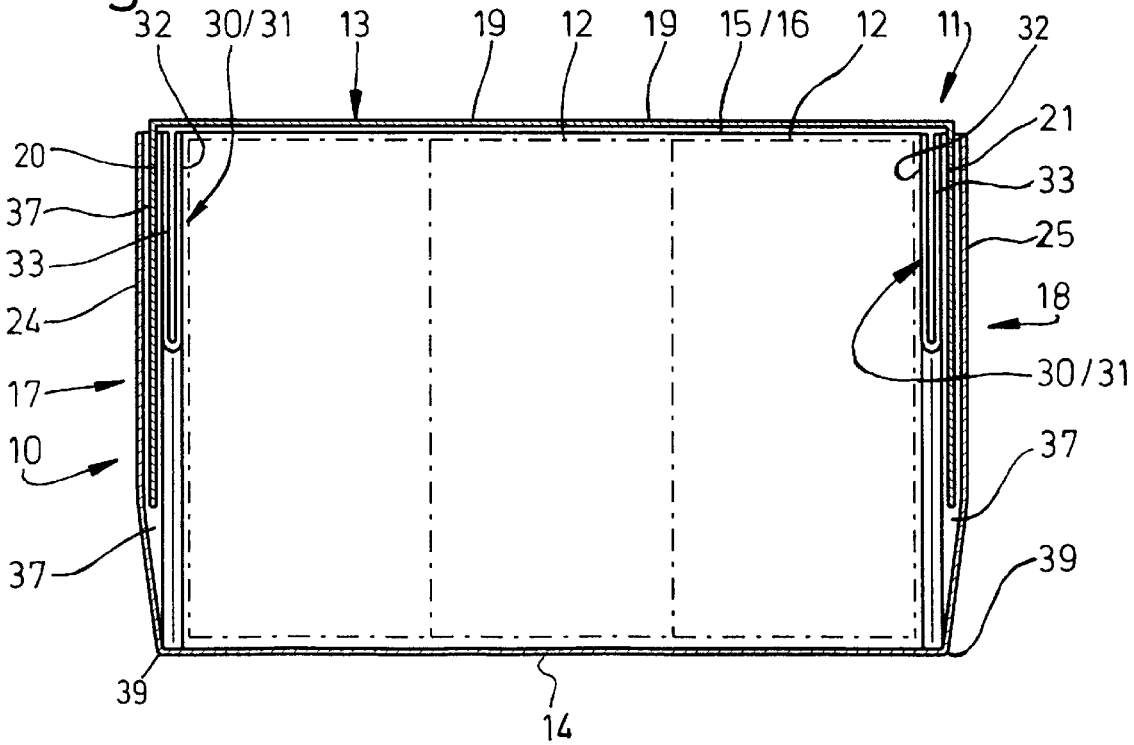

Fig. 11
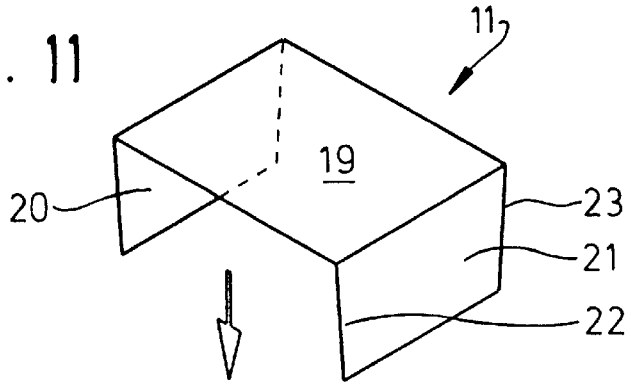
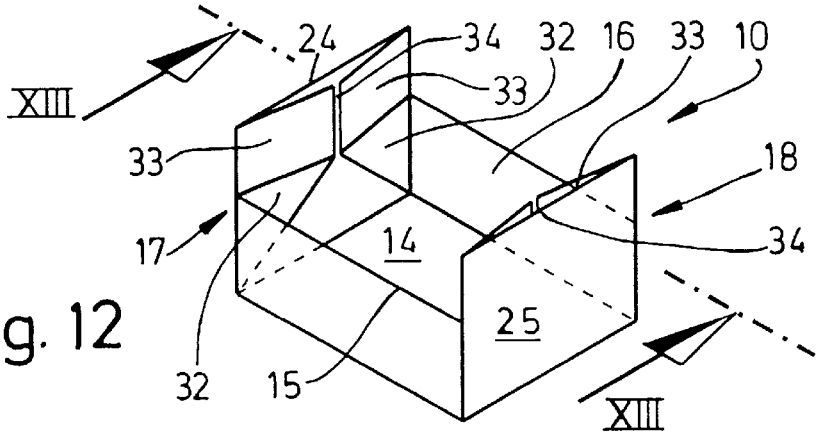
Fig. 12
Fig. 13
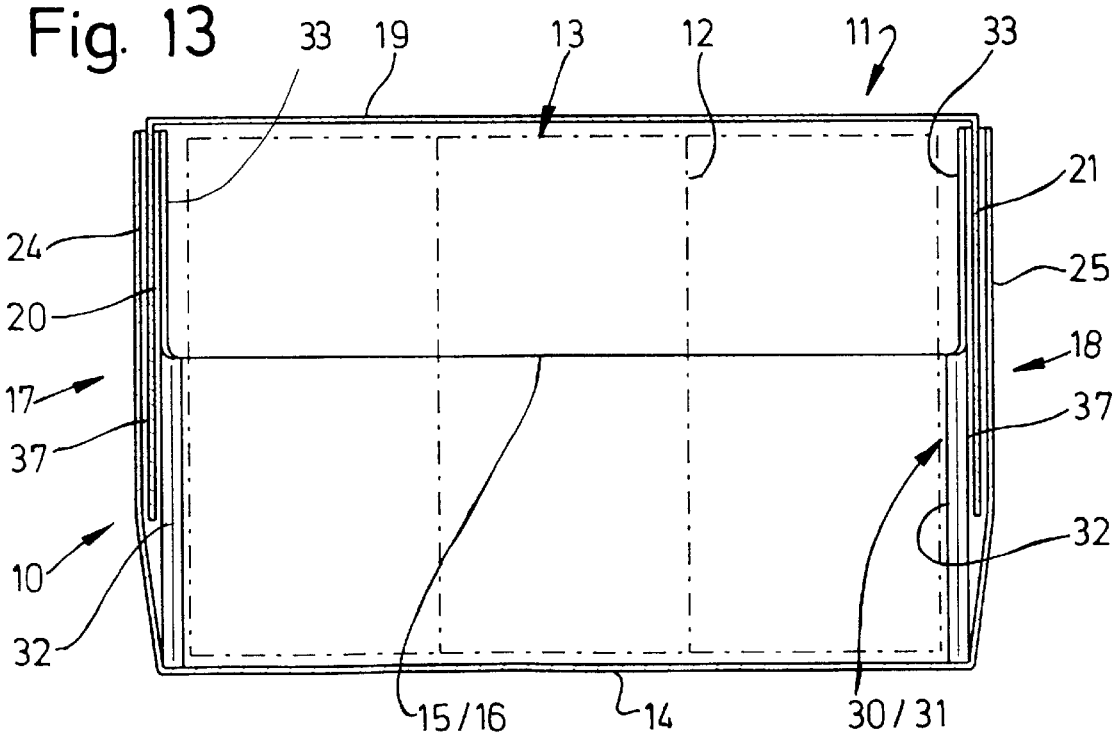

CARDBOARD PACKING CONTAINER

BACKGROUND OF THE INVENTION

The invention relates to a packing container made of foldable packaging material, especially cardboard, comprising a base part and an upper covering part which can be inserted into tile base part, the base part having packing walls formed by upright folding tabs.

Folding containers, especially folding cardboard boxes are known in different designs. Usually, two packing walls, lying opposite one another, namely side or end walls, consist of folding tabs which partially overlap one another. These are connected to one another by gluing and/or by stapling. This makes the manufacture of packaging of this type labour-intensive.

SUMMARY OF THE INVENTION

The purpose underlying the invention is to propose a packing container, especially a folding cardboard box, which, because of its structure, makes simpler manufacture possible.

In fulfillment of this purpose, the packing container according to the invention is characterised by the following features:

a) the base part has at least two packing walls lying opposite one another and formed by the upright folding tabs, b) the folding tabs, which are only folded, not connected to one another by gluing or any other connecting means, are held in the upright or folded position solely by the covering part, c) the covering part has at least two insertion tabs lying opposite one another and which can be inserted into the folds, formed by the folding tabs, of the packing walls, namely of the side or end walls, of the base part, in such a way that the folding tabs or folds are solely fixed by the insertion tabs inserted into same.

The subject-matter of the invention is therefore a packing container consisting especially of cardboard and in which there are no connecting means of any kind in the region of the folds or folding tabs. Rather, the covering part is designed in such a way that, when the cardboard box is closed, the folding tabs are held in the upright folded position by the covering part. When the folding cardboard box is first opened, for instance by removing the covering part, the folds are therefore also opened. This produces the surprising advantage that the contents of the packaging lie free as a result of unfolding. At least the base part can, in addition, be spread out into a flat (original) state because of the lack of connecting means in the region of the folding tabs, and thus the packed objects, especially a group of small packets, lie free on all sides.

A further surprising advantage lies in the fact that the disposal of the packing container is made easier. At least the base part can be brought into a flat, level shape by simple smoothing of the folding tabs. In this way it is possible to use the blanks of the packing container, especially the base part, for another packaging process, thus producing complete recycling of the packaging without loss of the material. Moreover, in its flat, level form the packing container has less volume and therefore takes up less space. This makes handling easier.

According to the invention, the base part is designed in such a way that folding tabs are formed in the region of end walls lying opposite one another, preferably in such a way that two groups of folding tabs are located on the inner side, i.e. on the side of the end wall turned towards the contents of the packaging. On the outside, a continuous, all-over cover tab is present. Portions of the covering part, especially insertion tabs, are inserted into the region between the folding tabs on the one hand and the outer cover tab on the other hand, in order to fix the folded position in this way.

The upper covering part consists advantageously of a covering wall with side, upright insertion tabs lying opposite one another.

The covering part can also consist of two separate covering parts, which in each case are connected to the base part as one piece.

To save material, side walls and/or end walls of the base part can be of different heights and can, in particular, be designed not to be as high as the contents of the packaging.

Further details of the invention relate to the design of the base part on the one hand and of the covering part on the other hand.

Embodiments of the invention, given by way of example, are explained in greater detail below with the aid of the drawings. These show:

BRIEF DESCRIPTION OF THE DRAWINGS

FIG. 1 and FIG. 2 parts of a packing container in simplified view and in perspective, FIG. 3 a closed packing container in longitudinal section in the plane III—III of FIG. 1 and FIG. 2, FIG. 4 a spread-out blank for a base part, FIG. 5 the base part according to FIG. 4 in an interim folding position, in perspective, FIG. 6 to FIG. 8 views analogous to FIG. 1, FIG. 2 and FIG. 3 of another embodiment, given by way of example, of a packing container FIG. 9 a spread-out blank for a base part of the packaging according to FIGS. 6 to 8, FIG. 10 a spread-out blank of a covering part according to FIG. 6, FIG. 11 to FIG. 13 views analogous to FIG. 1, FIG. 2 and FIG. 3 of an additional embodiment, given by way of example of the packing container, FIG. 14 a spread-out blank for a base part according to FIG. 12, FIG. 15 a spread-out blank for a covering part according to FIG. 11, FIG. 16 to FIG. 18 views of an additional embodiment, given by way of example, of a packing container, analogous to FIG. 1, FIG. 2 and FIG. 3, FIG. 19 a spread-out blank for a base part according to FIG. 17, FIG. 20 a packing container according to a further embodiment of the invention, given by way of example, in perspective, and FIG. 21 a spread-out blank for the packing container according to FIG. 20.

DESCRIPTION OF PREFERRED EMBODIMENTS

Figure 4:
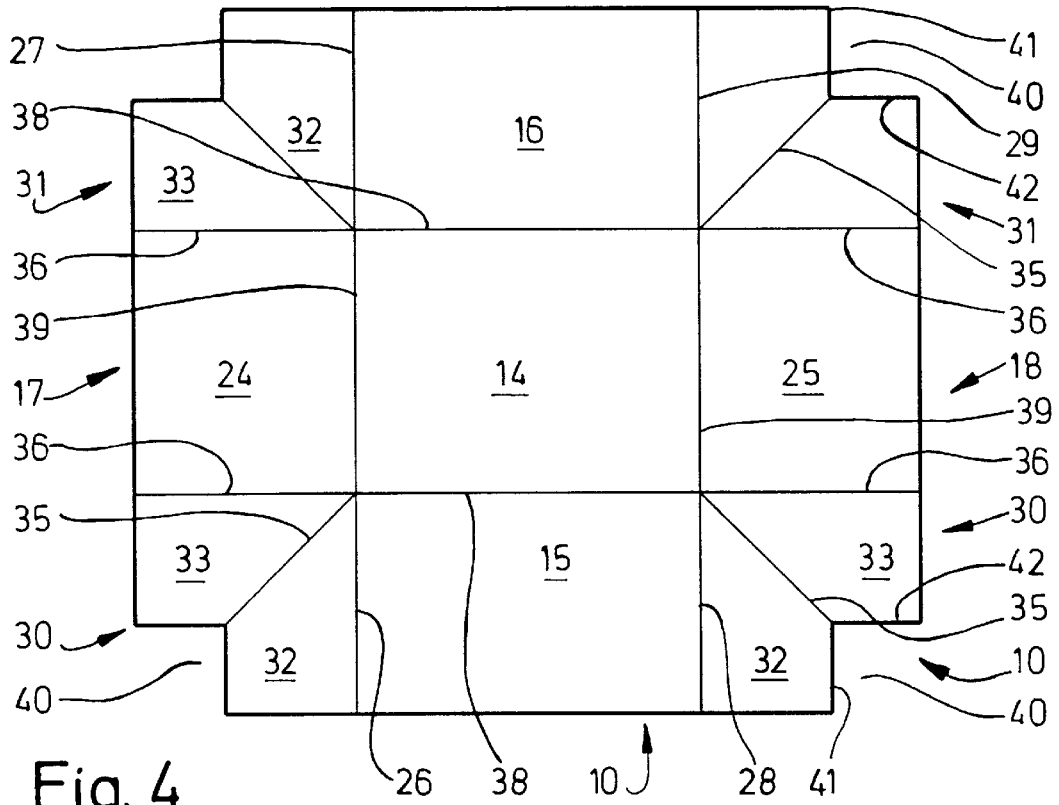
Figure 5:
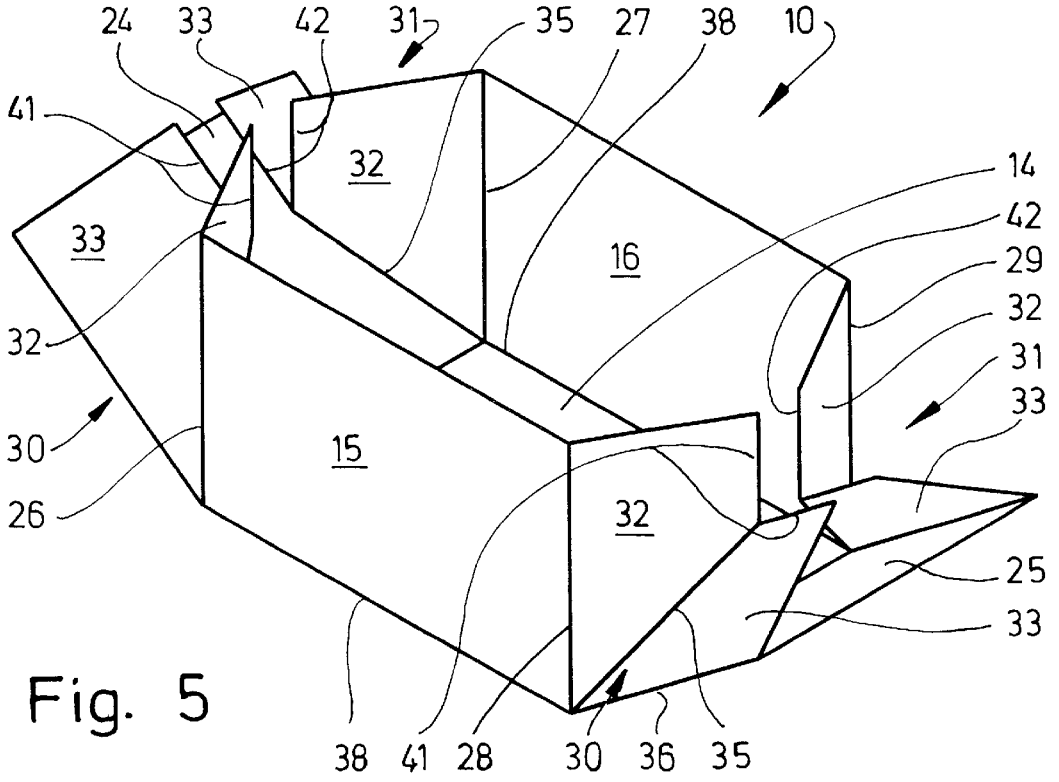
Figure 6:
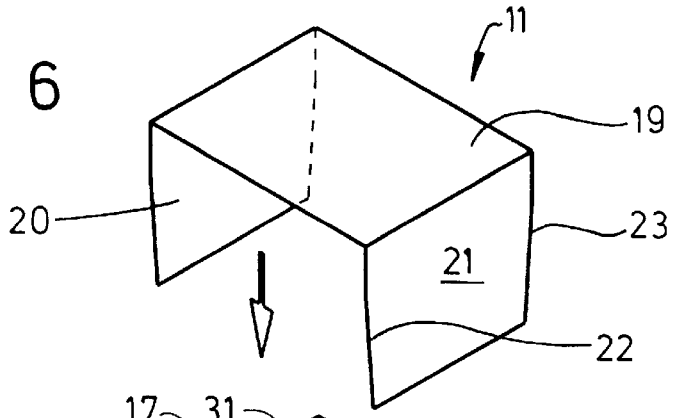
Figure 7:
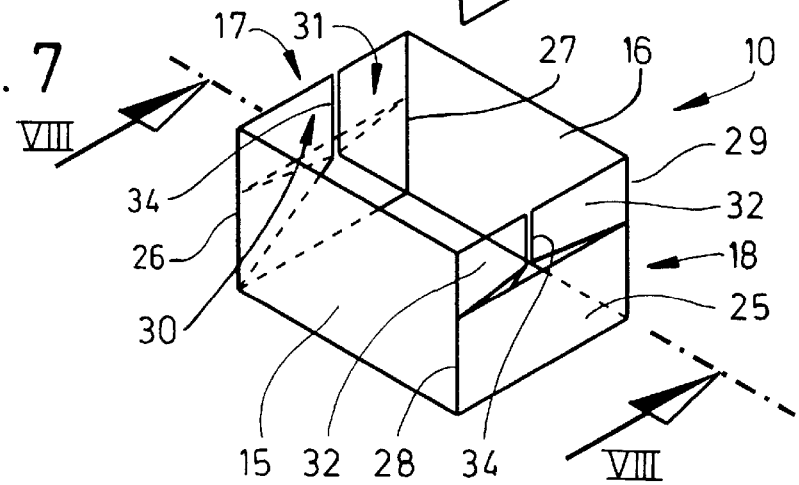

The embodiments of a packaging item, given by way of example and shown in FIGS. 1 to 19, consist of two parts, namely a lower base part 10 and an upper covering part 11. Both parts of the packing container consist of relatively stiff yet foldable material, especially cardboard, corrugated cardboard or the like. The packing container is intended to take individually packaged goods, especially (cuboid-shaped) unit packs 12. These can for instance be (vacuum) packs of coffee. The individual packs 12 are formed into a packing group or package 13, the individual packs 12 standing close up to one another in one or a plurality of rows. The contents of the package, namely the packing group 13, is thus an overall cuboid-shaped block.

The base part 10 is designed as a container which is open at the top with a base wall 14 and interconnected packing walls running round it. In the present embodiments, given by way of example, with a base part 10 of elongated cuboid shape, two (longer) side walls 15 and 16, lying opposite one another, are present and two end walls 17, 18 arranged transversely to same. These consist partially of folding tabs which overlap one another either completely or partially. The end walls 17, 18 are designed to be multilayered in parts.

The base part 10, which is open at the top, is closed completely or partially by the covering part 11. In the embodiments, given by way of example and shown here, the covering part 11 consists of an upper covering wall 19 and of upright insertion tabs 20 and 21 lying opposite one another. This gives the covering part 11 a U-shaped cross-section. The dimensions are preferably chosen to be such that the (rectangular) covering wall 19 corresponds to the basic dimensions of the packing container, i.e. covers the upper open side of the base part 10. In the region where they are connected with the covering wall 19, the insertion tabs 20, 21 have the same width as it, The insertion tabs 20, 21 are advantageously bordered with edges 22, 23 converging downwards, i.e. as tongues tapering downwards.

When the packing container is closed, base part 10 and covering part 11, are pushed into one another or connected with one another in such a way that folds of the base part 10 are held in upright folded position by the covering part 11. Folding tabs of the base part 10, in the present case in the region of the end walls 17, 18 are not connected to one another by gluing, stapling or in any other way, but adjoin one another without being connected. The insertion tabs 20, 21 of the covering part 11 are positioned so as to fix the relevant side walls of the base part 10—here the end walls 17, 18—in upright folded position. When the packing container is used, the covering part 11 is just pulled off upwards. This frees the folds in the region of the end walls 17, 18. The base part 10 is moved back into a flat, spread-out initial position of the blank on the basis of existing restoring forces or through external intervention. The contents of the packaging, i.e. the packing group 13, now stand freely accessible on the base wall 14.

In the embodiments, given by way of example and shown here, the end walls 17, 18 consist of folding tabs lying inwards and an outer covering layer 24, 25. The latter extends over the full height and width of the end walls 17, 18 with the exception of the example according to FIG. 7 and FIG. 8. The cover tabs 24, 25, lying externally, extend adjacent to four upright packing edges 26, 27, 28 and 29, which are formed from the adjoining walls of the base part 10, namely the side walls 15, 16.

The folding tabs lying inwards, i.e. turned towards the packaging contents or the packing group 13, consist in the present case, each of two folding units 30, 31. Each folding unit 30, 31 consists in turn of two folding tabs 32, 33, which overlap one another completely or partially. The folding units 30, 31, each consisting of two folding tabs 32, 33, lie here in a common plane, in each case separated by a small slit 34.

The folding tabs 32, 33 of each folding ,unit 30, 31 are of a different geometric shape. In the embodiment, given by way of example and according to FIGS. 1 to 5, the side walls 15, 16 and end walls 17, 18 are designed to be of the same height and to correspond to the contents i.e. to correspond with the height of the unit packs 12. In this design, folding units 30, 31 arise from corresponding folding tabs 32, 33 of the same size and which adjoin one another all over. The folding tabs 32, 33 are in each case designed as trapezoid (FIG. 4) and connected with one another along a folding edge 35 directed at an angle or diagonally. The inner folding tabs 32 (adjoining the packaging contents) are connected via the upright packing edges 26 . . . 29 in each case with the adjoining side wall 15, 16. The outer folding tabs 33, turned towards the cover tabs 24, 25 are in each case connected via a rim edge 36 with the associated cover tabs 24, 25.

In the upright folded position of the base part 10 formed in this way, the insertion tabs 20, 21 are inserted into a gap which is formed between the outer cover tabs 24, 25 on the one hand and the folding units 30, 31, on the other hand. The gap 37 goes over the full height of the end walls 17, 18. In order to avoid squeezing of the material, however, the insertion tabs 20, 21 inserted into this gap only extend over part of the height, i.e. end at a clear distance from the base wall 14 (FIG. 3).

In this position, the covering part 11 acts as a clamp, holding together the folded base part 10 via its end walls 17, 18. The folds of the end walls 17, 18 cannot be opened as long as the insertion tabs 20, 21 remain in the gap 37 inside the end walls 17, 18.

The base part 10 consists of a blank, which is shown in its spread-out state as a detail in FIG. 4. The blank is provided with embossed fold lines corresponding to the folding edges which are to be produced. The rim edges 36 for delimiting the cover tabs 24, 25 in relation to the adjacent folding tabs 33 are continued as fold line 38 in the region of the base wall 14 to form a folding edge between the base wall 14 and the adjacent side walls 15, 16. In the transverse direction, fold lines of the packing edges 26, 27 on the one hand and 28, 29 on the other hand are correspondingly connected with one another by transverse fold lips 39. The latter divide the base wall 14 from the cover tabs 24, 25.

In order to form folding tabs 32, 33 of the same size, overlapping one another in the folded position, the roughly rectangular blank is provided with right-angled cutouts 40 on its four corners. These cutouts delimit the trapezoid folding tabs 32, 33. The cutouts 40 are so dimensioned that the folding tabs 32, 33 lie opposite one another in the region of the upright slit 34 without overlapping. The slit 34 is delimited by upright tab edges 41, 42.

The embodiment, given by way of example and according to FIGS. 6 to 10, differs from the previously described embodiment, given by way of example, essentially in that the blank (FIG. 9) for the base part 10 has smaller dimensions, in order to save material. The layout is such that parts of the end walls 17, 18 only extend over a portion of the total height of the packing container or the packing group 13. The outer cover tabs 24, 25 are designed to be of lesser overall height and end in the present case slightly above half the height of the packing container. The folding tabs 32 lying inside, ie. turned towards the content of the packaging, extend over the full height of the packing container and thus of the side walls 15, 16. The folding tabs 33 extending between the cover tabs 24, 25 and these folding tabs 32 are, on the other hand, —like the cover tabs 24, 25—designed to be of lesser height.

Figure 8:
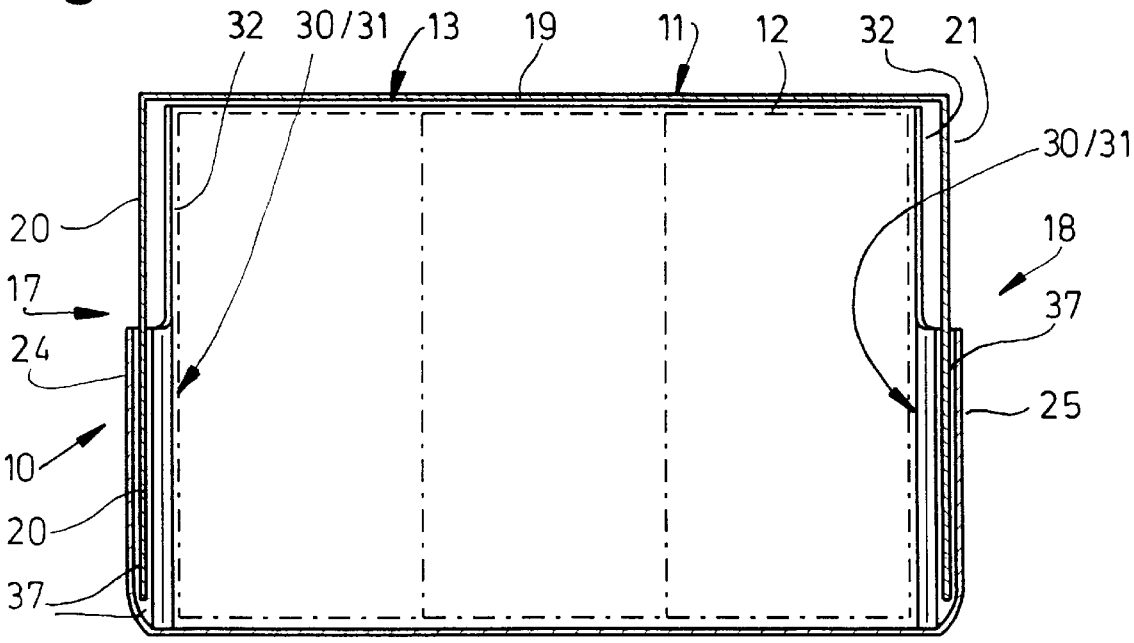
Figure 9:
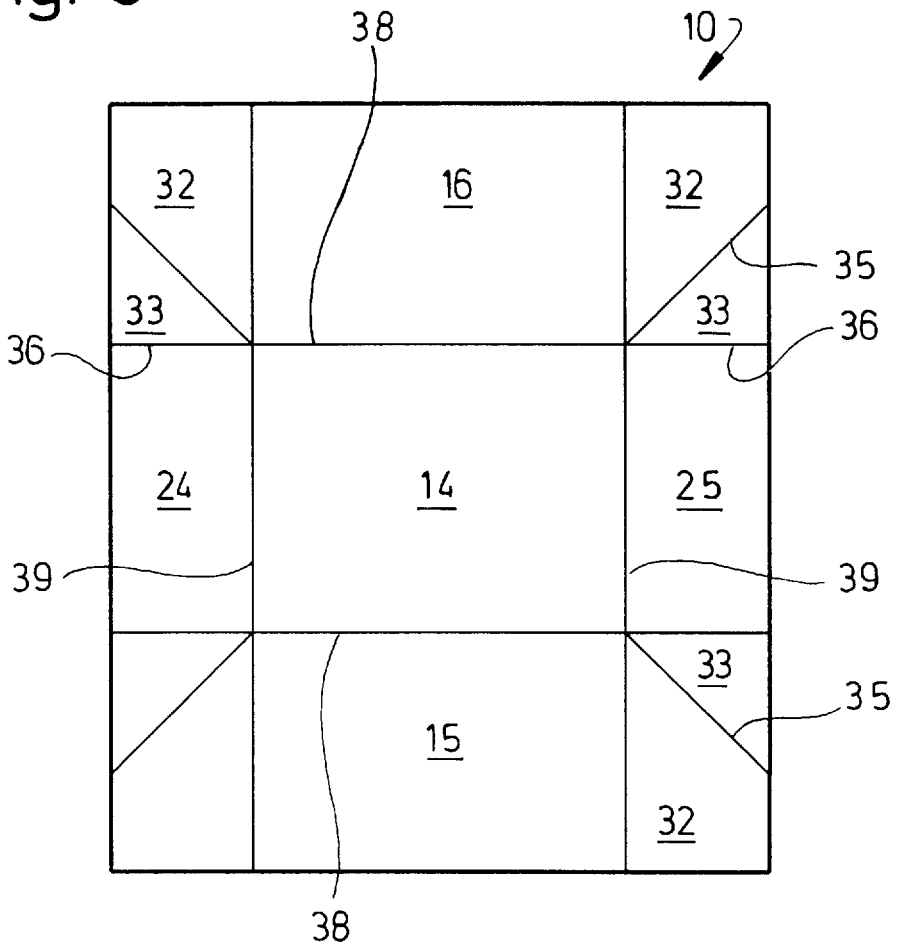
Figure 10:
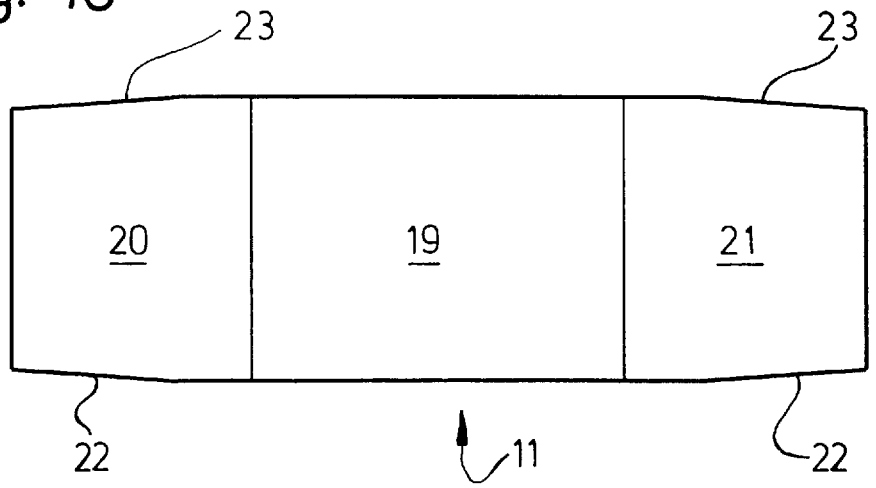

The covering part 11 corresponds substantially to that according to FIG. 1. The insertion tabs 20, 21 are, however, of greater height, in such a way that they extend almost to the base wall 14 of the base part 10 (FIG. 8). On the basis of the construction described, the gap 37 is of lesser height than in the embodiment, given by way of example, of FIG. 1. Upper regions of the insertion tabs 20, 21 thus lie free and form with the upper regions of the folding tabs 32 a portion of the end walls 17, 18. The insertion tabs 20, 21 are here designed so as to be formed over a portion of the height with parallel edges, and in the lower region with converging edges 22, 23 (FIG. 10).

The blank, which is rectangular here too, for the base part (FIG. 9) corresponds in respect of the arrangement of the fold lines to the embodiment, given by way of example and according to FIG. 4. However, on sides facing one another, strips of material in the width of the cutouts 40 are detached. This leads to different forms of the folding tabs 32, 33. The latter are here markedly smaller and designed only as triangular gussets. The folding tabs 32 (lying on the inside) extend over the full height of the packaging.

A further alternative with a reduced amount of material for the base part 10 arises from FIGS. 12 to 15. In reverse construction to the previous embodiment, given by way of example, the parts of the side walls 17, 18 lying on the inside, namely the folding tabs 32, only extend over part of the height, just over half the height of the packing container. The folding tabs 33 and the outer cover tabs 24, 25 extend, on the other hand, over the full height. Hence the gap 37 for receiving the insertion tabs 20, 21 is provided over the full height. The covering part 11 can be designed in the same way as in the embodiment, given by way of example, in FIG. 1.

In order to save more material, in this embodiment, given by way of example, the side walls 15, 16 only extend over part of the height of the packaging, i.e. at the same height as the folding tabs 32.

Figure 14:
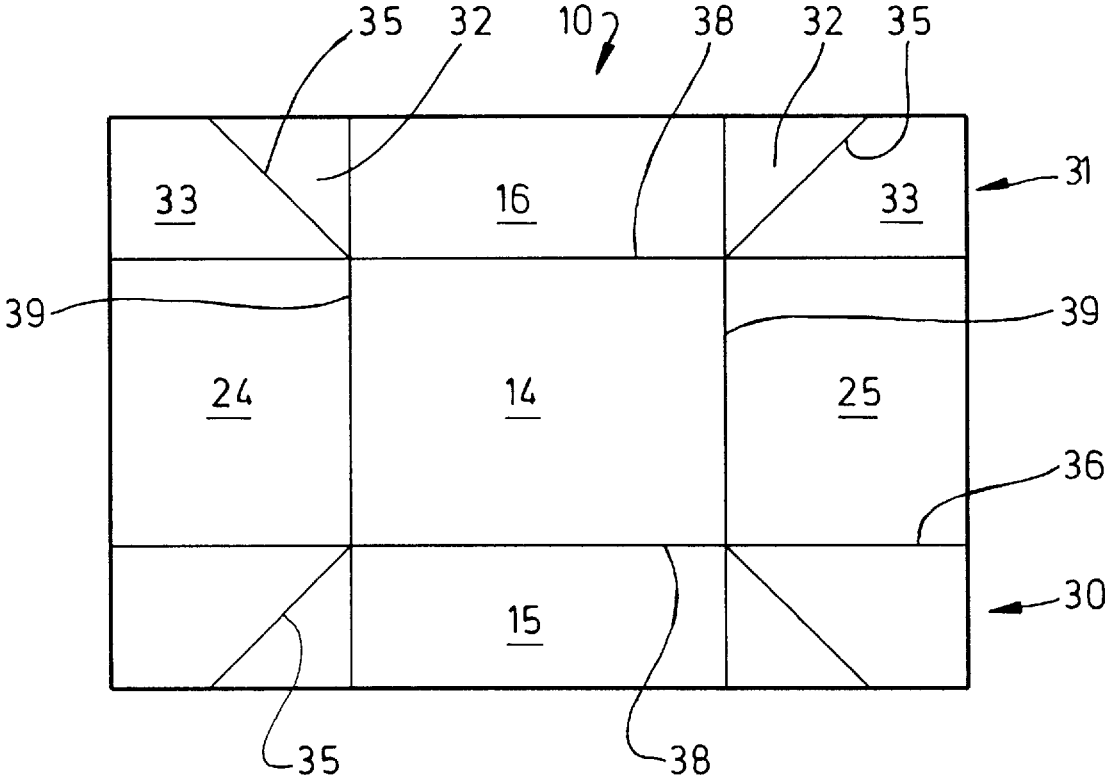
Figure 15:
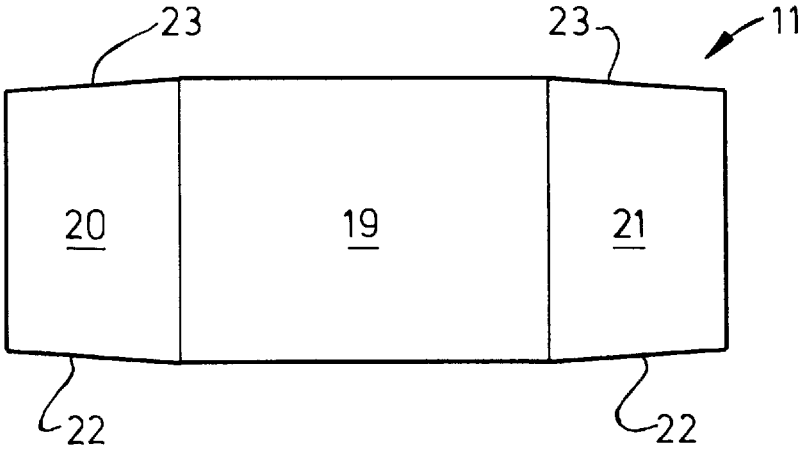
Figure 16:
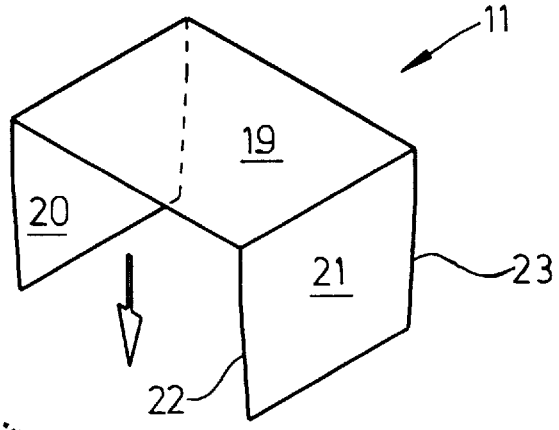
Figure 17:
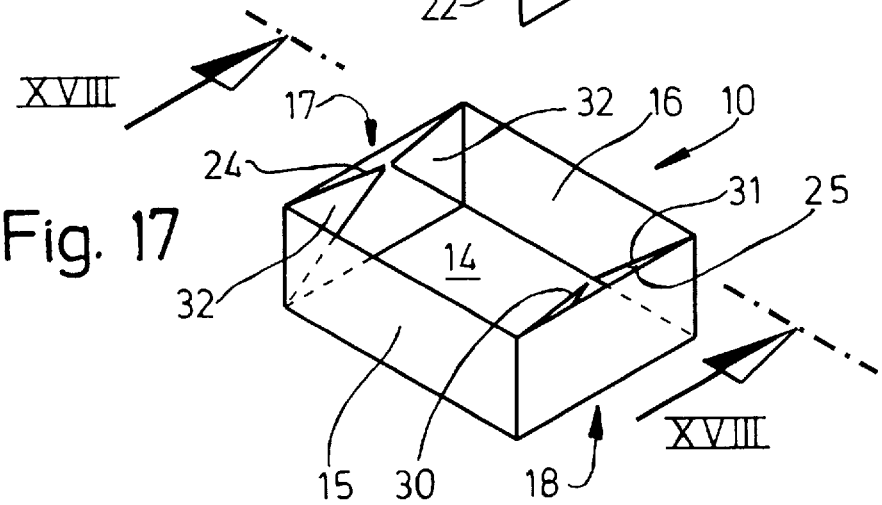
Figure 18:
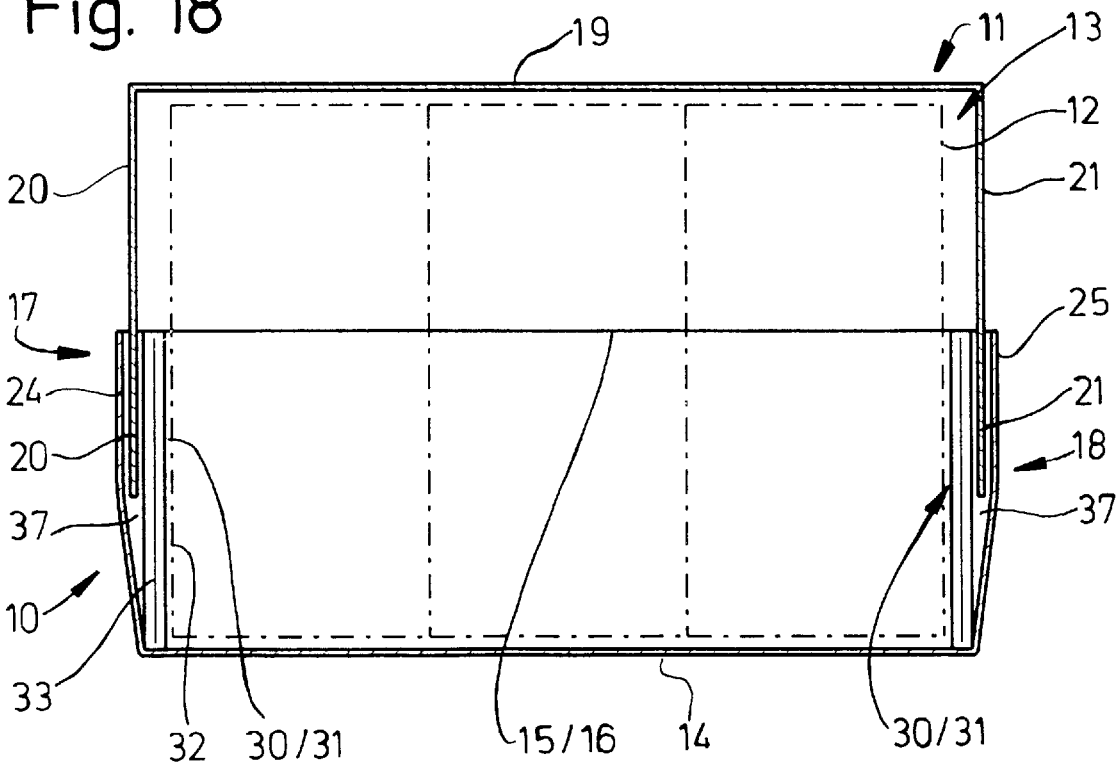

A blank for a base part 10 designed in this way arises from FIG. 14. Analogously to the blank according to FIG. 9, a strip of material has been removed parallel to the side walls 15, 16, which strip arises from the measurements of the cutouts 40. In this way, the folding tabs 32 lying on the inside are designed as triangular gussets.

Figure 19:
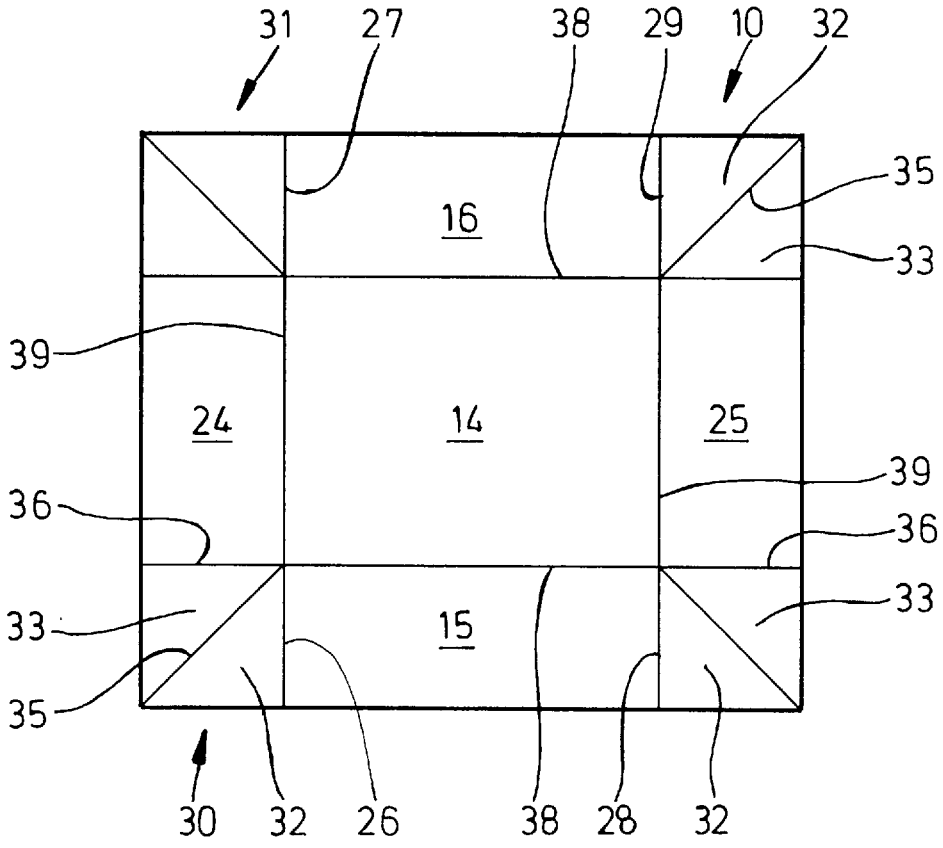

The embodiment, given by way of example and according to FIGS. 16 to 19, provides a maximum saving of material for the base part 10. The whole base part 10 here extends over part of the height of the contents of the packaging (packing group 13). The side walls 15, 16 and the end walls 17, 18 are here designed to be of the same height. This leads to a regularly shaped blank for the base part 10 (FIG. 19). The folding tabs 32, 33 are designed to correspond as triangular gussets of the same size which overlap one another completely in the folded position. The blank has arisen geometrically from the fact that edge regions of the blank adjoining the cutouts 40 have been left out on all sides.

On this packaging, in the region of the end walls 17, 18, the packing group 13 is covered in the upper part solely by the insertion tabs 20, 21. In the region of the side walls 15, 16, the unit packs 12 lie free at the sides above the side walls 15, 16. This packaging can therefore be considered for non-delicate packed items.

Figure 21:
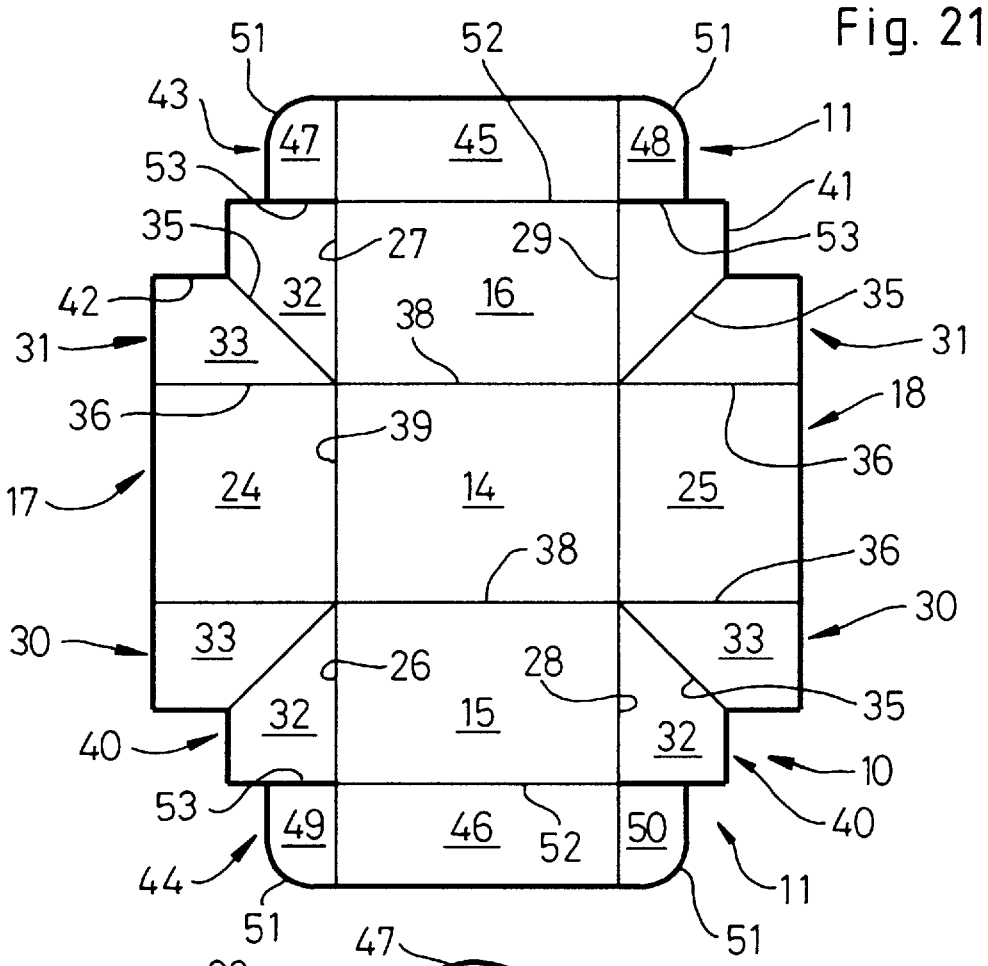
Figure 20:
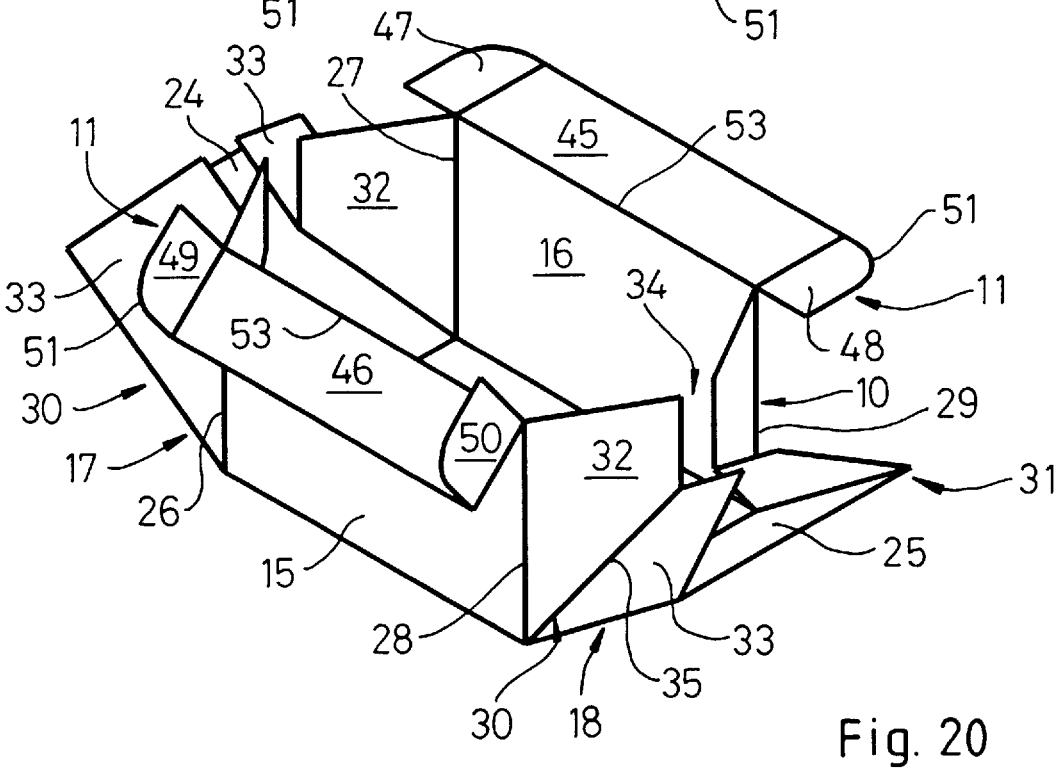

The packaging shown in FIGS. 20 and 21 consists likewise of a lower base part 10 and an upper covering part 11, however, in contrast to the embodiments given by way of example and according to FIGS. 1 to 19, the base part 10 and covering part 11 of the packaging according to FIGS. 20, 21 are made from a one-piece blank.

The base part 10 of the packaging according to FIGS. 20, 21 is designed to correspond with the base part 10 of the embodiment, given by way of example and according to FIGS. 1 to 5. It therefore has a base wall 14 and interconnected packing walls running around same. The base part 10 has namely two side walls 15, 16 lying opposite one another, as well as two end walls 17, 18 arranged transversely to same. These end walls consist in turn partly of folding tabs which overlap one another completely or partially. The end walls 17, 18 are designed to be multilayered in parts.

The base part 10 is completely or partially closed by the covering part 11. In the embodiment, given by way of example and according to FIGS. 20, 21, the covering part 11 consists of two covering part regions 43, 44. Each covering part region 43, 44 has a covering wall region 45, 46 as well as two insertion tabs facing one another 47, 48 or 49, 50. The covering part 10 consists therefore of the covering part regions 43, 44 which are separated from one another and which close the base part 10 when the packaging is folded together. The dimensions are here chosen to be such that a covering wall formed from the covering wall regions 45, 46 corresponds to the measurement of the base wall 14, i.e. closes the base part 10 completely. The width of the insertion tabs 47, 48 or 49, 50 is matched to the width of the covering wall regions 45 or 46 of the covering part regions 43 or 44. The insertion tabs 47, 49 or 48, 50, which abut against one another when the packaging is folded together, therefore have the width of the covering wall formed from the covering part regions 43, 44, or the width of the base wall 14. The insertion tabs 47 . . . 50 have rounded corners 51. The rounded corners 51 make it easier for the insertion tabs 47 . . . 50 to be inserted into the gap 37 formed between the folding units 30, 31 and the outer cover tabs 24, 25.

In the embodiment, given by way of example and according to FIGS. 20, 21, too, when the packing container is closed, base part 10 and covering part 11 are pushed into one another in such a way that folds in the region of the base part 10 are held in upright folded position by the covering part regions 43, 44. Folding tabs of the base part 10 thus adjoin one another unconnected, without being interconnected by gluing or the like. Accordingly, the insertion tabs 47 . . . 49 fix the packing walls or side walls of the base part 10 in an upright folded position. When the packing container is used, only the covering part regions 43, 44 have to be pulled upwards and folded away at the side. In this way, the folds in the region of the end walls 17, 18 become free. The base part 10 as well as the covering part 11 are then moved back into a flat, spread-out initial position of the blank on the basis of existing restoring forces or through external intervention.

The base part 10 of the packaging according to FIGS. 20, 21 has the same basic structure as the base part of the embodiment, given by way of example and according to FIGS. 1 to 5. The end walls 17, 18 are accordingly formed from folding tabs lying on the inside and the outer cover tabs 24, 25. The outer cover tabs 24, 25 extend in turn adjacent to the four upright packing edges 26 . . . 29. The folding tab turned towards the contents of the packaging consists, analogously to the embodiment, given by way of example and according to FIGS. 1 to 5, of the two folding units 30, 31 which in turn each consist of two folding tabs 32, 33. The folding units 30, 31 formed from the folding tabs 32, 33 lie again in a common plane and are in each case divided from one another by the narrow slit 34. Reference can be made to the explanations above with regard to the details concerning the folding tabs 32, 33.

Base part 10 and covering part 11 are accordingly formed from a common blank. The folding tabs 32, 33 are again connected with one another via folding edges 35 directed transversely. The folding tabs 33 as well as the cover tabs 24, 25 are in each case connected with one another via the rim edges 36. The rim edges 36 for delimiting the cover tabs 24, 25 in respect of the adjacent folding tabs 33 are continued as fold lines 38 in the region of the base wall 14. In the transverse direction, transverse fold lines 39 are formed correspondingly.

The region of the blank for the base part 10 has the right-angled cutouts 40 . In respect of these, too, reference can be made to the explanations above. The upright tab edges 41, 42 delimit the slit 34.

The cover wall regions 45, 46 of the covering part regions 43, 44 of the cover part 11 adjoin at the side, beside the side walls 15, 16. The covering wall region 45 is adjacent to the side wall 16, the covering wall region 46 adjacent to side wall 15. Adjacent side walls 15 or 16 and covering wall regions 46 or 45 are in each case divided from one another by fold lines 52. The insertion tabs 47 . . . 50 of the covering part regions 43,44 are arranged at the side of the covering wall regions 45, 46 and adjacent to the folding tabs 32. The regions of the blank constituting the folding tabs 32 and insertion tabs 47 . . . 50 are divided by separating cuts 53 from one another. The separating cuts 53 end in the region of the packing edges 26 . . . 29 and continue in the region of the side walls 15, 16 or covering wall regions 46, 45 into the fold lines 52. This guarantees that the insertion tabs 47 . . . 50 can be inserted into the folds of the end walls 17, 18 formed by the folding tabs 32, 33.

What is claimed is:

1. A packing container made of foldable packaging material, and comprising a bottom base part (10) and an upper covering part (11) which can be inserted into the base part (10), wherein:

said base part (10) has at least two packing walls lying opposite one another and each formed by a pair of upright folding tabs (32, 33);

said upright folding tabs (32, 33), which are only folded and are not connected to one another by gluing or any other connecting means, are held in an upright position solely by said covering part (11);

said covering part (11) has at least two insertion tabs (20, 21; 47, 48, 49, 50), lying opposite one another, which can be inserted into the folds formed by said upright folding tabs (32, 33) of the two packing walls in such a way that the folding tabs (32, 33) are fixed solely by the insertion tabs (20, 21; 47, 48, 49, 50) inserted in the folds;

said packing walls comprise two end walls (17, 18) facing one another; an inner folding unit (30, 31) is formed from each pair of folding tabs (32, 33) overlapping one another; each end wall has an outer cover tab; and between each folding unit (30, 31) and each outer cover tab (24, 25), there is a gap (37) into which said insertion tabs (20, 21; 27, 48, 49, 50) are inserted; and said packing walls of the base part (10) are of lesser height than the contents of a package (13) inserted in said base part (10).

2. The packing container according to claim 1, wherein only portions of the end walls (17, 18), each being formed by an inner folding unit and an outer cover tab, are of lesser height than the contents of a package (3) inserted in said base part (10).

3. The packing container according to claim 1, wherein the base part (10) is overall of a lesser height than the contents of the package, upper regions of the contents being covered in the region of the end walls (17, 18) by the insertion tabs (20, 21) of the covering part (11), and upper regions of the contents lying free above side walls (15, 16) of the base part (10).

4. A packing container made of foldable packaging material, and having a base part (10), open at its top, and an upper covering part (11), wherein:

said base part (10) comprises a bottom wall (14), a pair of opposing upright side walls (15, 16), and a pair of opposing upright end walls (17, 18) formed by folding;

said end walls (17, 18) comprise continuous outer cover tabs (24, 25), and inner folding units (30, 31) which are made of folding tabs (32, 33) that are folded in a triangular or trapezoid shape and that are not connected to each other by any bonding means;

said upper covering part (11) comprises a separate U-shaped folded blank which is separate from said base part, and which comprises an upper covering wall (19) and insertion tabs (20, 21) formed on opposite ends thereof and directed downwards toward said bottom wall;

said insertion tabs (20, 21) are inserted in gaps (37) between the cover tabs (24, 25) and the folding units (30, 31); and each of said insertion tabs (20, 21) has a width approximately equal to a width of a corresponding one of said end walls (17, 18).

5. The packing container according to claim 4, wherein said cover tabs (24, 25) of the end walls (17, 18) are of lesser height than the folding units (30, 31).

6. The packing container according to claim 4, wherein said folding units (30, 31) are of lesser height than the cover tabs (24, 25).

7. The packing container according to claim 4, wherein said insertion tabs (20, 21) of the covering part (11) are of greater height than the base part (10) so that the covering wall (19) extends at a distance from the base part (10).

8. The packing container according to claim 4, wherein the end walls (17, 18) of the base part (10) are of greater height than the side walls (15, 16) so that the contents of the packaging (12) are exposed in a region between the side walls (15, 16) of the base part (10) and the covering wall (19) of the covering part (11).

9. The packing container according to claim 4, wherein the base part (10) comprises a rectangular blank which has a cutout (40) in each of its four corners to form trapezoid-shaped folding tabs (32, 33) in connection with a folding edge (35), so that each of the adjacent folding units (30, 31) of pack end wall (17, 18) extends over approximately half a width of the end walls (17, 18).

10. The packing container according to claim 4, wherein the base part (10) comprises a rectangular blank which has rectangular fields in its four corners, said fields being divided by an obliquely directed folding edge (35) into a trapezoid-shaped folding tab (32) and a triangular-shaped folding tab (33) which form, as a whole, a folding unit (30, 31), and wherein neighboring folding units (30, 31) of an end wall (17, 18) do not overlap each other.

11. A packing container made of foldable packaging material, and having a base part (10), open at its top, and an upper covering part (11), wherein:

said base part (10) comprises a bottom wall (14), a pair of opposing upright side walls (15, 16), and a pair of opposing upright end walls (17, 18) formed by folding;

said end walls (17, 18) comprise continuous outer cover tabs (24, 25) and inner folding units (30, 31), each folding unit (30, 31) consisting of trapezoid-shaped folding tabs (32, 33);

said base part (10) and said covering part (11) consist of a common, one-piece four-sided blank which has a cutout (40) in each of its four corners;

said covering part (11) comprises two covering part regions (43, 44) separated from each other, each being connected to a respective one of said side walls (15, 16);

each covering part region (43, 44) has two opposing insertion tabs (47, 48; 49, 50) which are partitioned from adjoining folding taps (32) by a separating cut (53); and insertion tabs (47, 48; 49, 50) are inserted in respective gaps (37) formed between the cover tabs (24, 25) and the folding units (30, 31).

* * * * *